United States Patent [19]

Brown

[11] Patent Number: 4,803,747

[45] Date of Patent: Feb. 14, 1989

[54] ORTHOTIC AND METHOD OF MAKING OF THE SAME

[76] Inventor: Dennis N. Brown, 8528 Custer School Rd., Custer, Wash. 98240

[21] Appl. No.: 142,722

[22] Filed: Jan. 11, 1988

Related U.S. Application Data

[62] Division of Ser. No. 837,584, Mar. 7, 1986, Pat. No. 4,718,179.

[51] Int. Cl.[4] ..... A43B 13/41; A43B 13/40

[52] U.S. Cl. ..... 12/142 N; 128/595; 12/146 M

[58] Field of Search ..... 36/43, 44, 71, 88, 80, 36/81, 92, 76 C; 12/142 N, 146 M; 128/584, 585, 595, 614, 619, 622

[56] References Cited

U.S. PATENT DOCUMENTS

| | | | |
|---|---|---|---|
| 2,330,978 | 10/1943 | Klein | 12/146 M |
| 4,510,700 | 4/1985 | Brown | 36/44 |
| 4,513,518 | 4/1985 | Jaubert et al. | 36/43 |
| 4,597,196 | 7/1986 | Brown | 36/44 |
| 4,669,142 | 6/1987 | Meyer | 12/146 M |
| 4,718,179 | 1/1988 | Brown | 36/44 |

OTHER PUBLICATIONS

"Paying Through The Feet", Hal Higdon, The Runner 11/1982 pp. 86–90.

*Primary Examiner*—Steven N. Meyers
*Attorney, Agent, or Firm*—Hughes, Cassidy & Multer

[57] ABSTRACT

A relatively rigid cap is made of a material which is deformable at moderately elevated temperatures. A flexible blank contoured to fit a person's foot is placed against the cap which is at the elevated temperature, and these two are placed against the plantar surface of the foot. A plastic bag is placed around the cap, the blank and the foot, and a blank is applied to conform the cap and the blank to the person's foot so as to make a custom fit orthotic. Upon cooling, the cap remains properly contoured relative to the plantar surface of the foot.

11 Claims, 9 Drawing Sheets

ORTHOTIC AND METHOD OF MAKING OF THE SAME

BACKGROUND OF THE INVENTION

1. Field of the Invention

This application is a divisional of application Ser. No. 837,584, filed Mar. 7, 1986, now U.S. Pat. No. 4,718,179.

The present invention relates to an improved orthotic particularly arranged and adapted to be made by a relatively convenient and rapid process or method, and also to the method of making the orthotic.

2. Background Art

An orthotic insert can be either soft or hard. A hard insert is a substantially rigid member, desirably having a relatively thin vertical thickness dimension and extending from the calcaneus area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

A common method of making an orthotic insert is first to prepare a negative mold of a person's foot, such as a plaster of paris mold. One desirable way of accomplishing this is described in U.S. Pat. No. 3,995,002, entitled "Orthocasting System", the inventor being the same as the applicant herein. In that method, a moldable material is placed against the bottom of the person's foot, and a flexible plastic bag is placed around the moldable material and the person's foot, so as to extend upwardly around the person's ankle. Further, a suction hose is placed within the bag so that the inlet to the hose is positioned on the upper part of a person's foot. A vacuum is applied to cause atmospheric pressure to press against the bag and also press the moldable material upwardly against the plantar surface (i.e. bottom surface) of the person's foot, and also a short distance upwardly around the side of the person's foot. The operator properly positions the person's foot so that the mold is properly formed in the desired configuration. Generally, this will be accomplished by the operator placing the person's foot in the neutral position and manipulating the forward part of the foot so that the midtarsal joint is in the locked or nearly locked position. This may vary somewhat, depending upon individual considerations in making the orthotic.

After the moldable material has hardened to make the mold, the plastic bag and the mold are removed. Then a positive cast is made from the mold (this generally being a plaster of paris cast, the contours of which correspond to the person's foot). From this positive cast, the orthotic can be made.

It is also known in the prior art to make an orthotic insert by preheating a moldable material, such as a cork-like material, and placing this in a relatively rigid base member having the general contour of a person's foot. The base member and the moldable cork material (which is heated to make it more yielding, and thus moldable) is placed against the person's foot, and the plastic bag is then placed around the base member, the moldable cork material, and the person's foot. A vacuum is applied as described above, and the moldable cork material cools to make the orthotic insert. The base member is removed from the orthotic insert, and this base member can be used again in subsequent molding of an orthotic.

As a modification of the process noted above, instead of using a reusable base member, which does not become part of the orthotic, a relatively rigid cap can be utilized, with this cap becoming part of the finished orthotic. In this particular method, the moldable cork-like material is palced within the cap, along with an upper yielding blank, and in the preferred embodiment an intermediate flexible member. The cork-like material is heated so as to be yielding and thus moldable, and the cap can also be heated, primarily to keep the cork-like material at an adequately high temperature during the forming process. Then the vacuum bag is applied and the vacuum imposed, as described above. The components are then permitted to cool, with the cap, the cork material, the flexible blank and the flexible insert forming the finished orthotic. Such a procedure is described in pending U.S. patent application Ser. No. 766,049, entitled "Improved Orthotic Insert and Method of Making the Same", the inventor being the same as the applicant herein.

To turn our attention now to other aspects relevant to the background of the present invention, there will now be a discussion of the following: (a) the main components or parts of the human leg and foot and how these function relative to one another; (b) the gait cycle which a person goes through in a normal walking motion; and (c) the intended function of a rigid orthotic in optimizing the coordinated operation of the person's foot and leg throughout the gait cycle.

For convenience, these various topics will be discussed under appropriate subheadings.

(a) The Main Components or Parts of the Human Leg and Foot and How These Function Relative to One Another With reference to FIGS. 1–3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it enables the entire foot to be articulated upwardly and downwardly (in the motion of raising or lowering the forward part of the foot). However, the talus 20 is connected to the tibia 16 and fibula 18 in such a way that when the entire leg 14 is rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction). There is also the midtarsal joint 38, and this will be discussed later.

To explain further the hinge motion of the subtalar joint 36, reference is now made to FIGS. 4*a* and 4*b*. The talus 20 can be considered as a vertical board 40, and the calcaneus 22 as a horizontally extending board 42, these being hinge connected to one another along a diagonal hinge line 44, with this hinge line corresponding to the subtalar joint 36. It can be seen with reference to FIG. 4*a* that as the talus 20 is rotated inwardly about its vertical axis (i.e. the front part of the leg being rotated toward the center of the person's body), there is a corresponding rotation of the calcaneus 22 (i.e. the horizontal board 42) about a horizontal axis. It can be seen in FIG. 4*b* that an opposite (i.e. outward) rotation of the talus 20 (i.e. the vertical board 40) causes a corresponding rotation of the calcaneus 22 (i.e. the horizontal board 42) in the opposite direction to that shown in FIG. 4*a*.

This motion described with reference to FIGS. 4*a* and 4*b* above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking mechanism of the midtarsal joint which occurs when there is an outward motion of the leg 14 and the talus 20 (outward motion meaning the rotation of the leg 14 about the vertical axis of the leg 14 in a manner that the knee moves outwardly from the person's body), and an opposite inward motion, respectively. When the leg 14 rotates inwardly, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

This function of the midtarsal joint will now be explained relative to FIGS. 5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45 engages the underlying support surface in a manner so as to remain generally horizontal to the support surface.

It can be seen that when the two board members 40 and 42 are in the pronated position of FIG. 5*a*, the metatarsal joint represented at 50 in FIGS. 5*a–b* is in a first position which will be presumed to be an unlocked position. In the unlocked position of FIG. 5*a*, the member 46 is not rigid with the horizontal member 42, and the forward member 46 can flex upwardly relative to the horizontal member 42. (This is the pronated position of the foot 10.) However, in the position of FIG. 5*b*, the board members 46 and 42 will be presumed to be locked to one another so that the members 42 and 46 form a unitary lever. For ease of illustration, no attempt has been made to illustrate physically the unlocking relationship of FIG. 5*a* and the locking relationship of FIG. 5*b*. Rather, the illustrations of FIGS. 5*a–b* are to show the relative movement of these components, and the locking and unlocking mechanism is presumed to exist.

(b) The Gate Cycle Which the Person Goes Through in a Normal Walking Motion

Reference is first made to FIGS. 6*a* and 6*b*. As illustrated in the graph of FIG. 6*a*, during the normal walking motion, the hip (i.e. the pelvis) moves on a transverse plane, and this movement in the gait cycle is illustrated in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*). However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to the foot by the forward part of the foot making ground contact.

With further movement from the 25% to the 75% position, the leg rotates in an opposite direction (i.e., to the outside so that the midtarsal joint 38 becomes supinated at the 75% location of FIG. 7*a*. This locks the midtarsal joint 38 so that the person is then able to operate his or her foot as a rigid lever so as to raise up onto the ball of the foot and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) The Intended Function of the Orthotic to Improve Operation of the Person's Foot and Leg Throughout the Gait Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly (i.e., to bring the person's foot back to the ideal functioning position peculiar to the person's foot), and to thus control the subsequent motion of the foot parts or components that make up these joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement. The only way that the plantar surface of the foot can be controlled is by a three dimensional member conforming to the plantar surface.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components.

SUMMARY OF THE INVENTION

In view of the foregoing, it is an object of the present invention to provide an improved orthotic, and more particularly such an orthotic which readily lends itself to being made by a relatively quick and convenient method, with the orthotic and the method having a balance of desirable characteristics, relative to the considerations noted above.

In the method of the present invention, there is first provided a relatively rigid cap made of a material which is characterized in that at a lower temperature, the material is resilient and upon deformation tends to return to its original shape. At a moderately elevated temperature, the material can take a permanent deformation which then becomes fixed at said lower temperature.

There is also provided a relatively flexible blank member configured to fit beneath and engage a plantar surface of the foot.

The cap is heated to the moderately elevated temperature, and then the blank is fitted against an upper surface of the cap. The cap and the blank are placed against the plantar surface of the foot while the cap is at the elevated temperature. A substantial uniform pressure is applied against an outer surface of at least the cap so as to cause the cap to assume to assume a configuration and contour matching the plantar surface of the foot.

The cap and the blank are permitted to cool so as to become bonded to one another, and also to form the orthotic which is contoured to properly fit against the plantar surface of the person's foot. In a preferred form, the heel portion of the cap has a centrally located through opening positioned at a lower culminating portion of a heel of the foot which engages the orthotic. A middle heel portion of the blank overlies the opening, so that additional cushioning effect is provided at the middle central heel portion of the blank. Desirably, the central heel portion of the blank has a downwardly protruding blank portion which fits into the opening of the heel portion of the cap.

Further, in the preferred form, the blank is provided with stabilizing element means connected to and extending downwardly from lower side surface portions of the heel portion of the cap. The blank is formed with downwardly protruding locating element means configured to fit into corresponding recess means provided by the stabilizing element means. The method further comprises interfitting the blank and the cap so that the locating element means properly fits in the recess means so as to properly locate the blank relative to the cap. Desirably, the stabilizing element means comprises first and second sets of stabilizing elements located on opposite sides of the heel portion of the cap. At least some of the stabilizing elements have recesses to receive matching locating elements of the blank.

In a further preferred form, a forefoot portion of the cap is arranged to a slot means, and the blank has on its lower surface matching second locating element means adapted to interfit with the slot means. Desirably, the slot means comprises a plurality of longitudinally extending slots positioned at spaced locations at the forefoot portion of the cap. The method further comprises moving at least a selected portion of the cap positioned between the adjacent pair of slots, so as to provide a pressure relief area at the forefoot portion of the cap.

In a further preferred form, the heel portion of the cap has laterally extending side portions dimensioned to extend beyond a heel of a foot of a narrower width. The method further comprises applying pressure to said side portions of the heel portion of the cap, while the cap is at the elevated temperature. This deforms the side portions upwardly to cradle the foot of narrower width.

A further feature is to form the stabilizing element means with vertically spaced notches to identify vertically spaced locations on the stabilizing element. The method further comprises removing a lower surface portion of one or more of the stabilizing elements by utilizing the notches as a depth indicator. This insures controlled removal of material from the stabilizing element.

The pressure is applied against the cap and the blank in the preferred form by enclosing the cap and the blank and also the foot in a bag. A vacuum is applied within the bag to cause atmospheric pressure to press the cap into a configuration for proper engagement with the plantar surface of the foot.

The orthotic made in accordance with the present invention has a cap and a blank as described above. Further, the orthotic has the structural features such as described above.

As additional features, the cap is provided with laterally spaced longitudinally extending reinforcing members. In one arrangement, the reinforcing members comprise flat strips or reinforcing elements made integral with the blank. In another arrangement, the reinforcing members are provided by deforming elongate portions of the cap downwardly to make a V-shaped recess. This results in a V-shaped reinforcing element.

Further, ridge-like members can be provided on the reinforcing member, with these ridge-like members being capable of being selectively removed. Thus, the rigidity or amount of yield of the cap under a given force can be controlled more accurately.

Other features of the present invention will become apparent from the detailed description.

Figure 1:
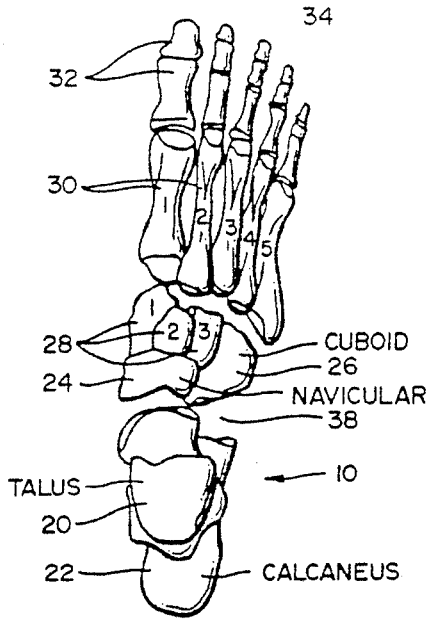
FIG. 1 is a top plan view of the right foot of a human, with certain components of the foot being separated from one another for purposes of illustration.
Figure 2:
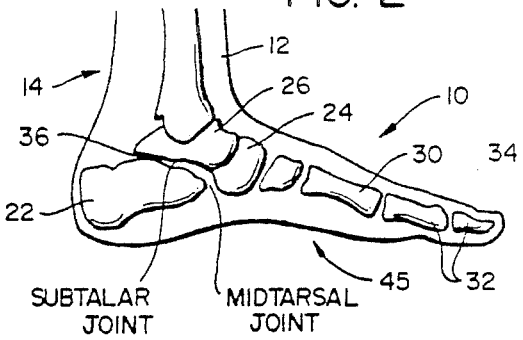
FIG. 2 is a side elevational view looking toward the inside of a person's left foot, with the outline of the foot and lower leg being shown as a shaded area.
Figure 3:
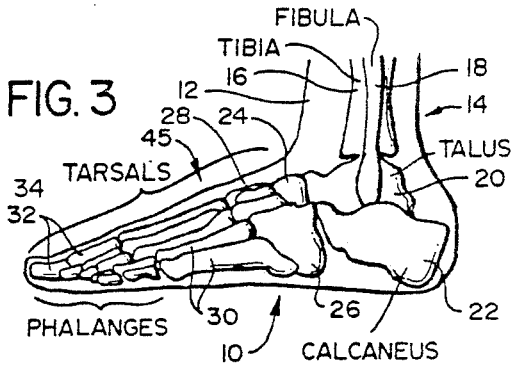
FIG. 3 is a view similar to FIG. 2, but looking toward the outside of the person's foot.
Figure 4A:
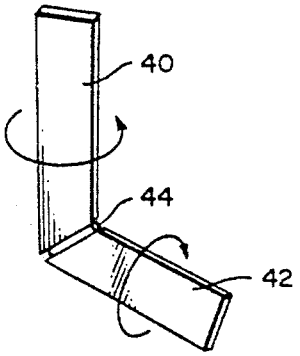
FIGS. 4*a* and 4*b* are perspective views illustrating schematically the rotational movements of the talus and calcaneus about the subtalar joint.
Figure 4B:
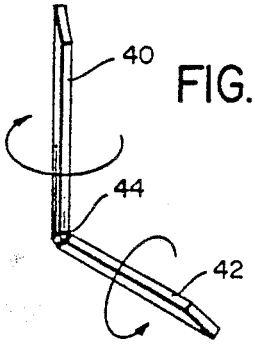
Figure 5A:
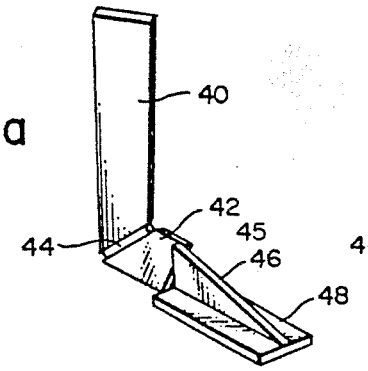
FIGS. 5*a* and 5*b* are schematic views similar to those of FIGS. 4*a–b*, but further illustrating the relative movement between the calcaneus and the midfoot about the midtarsal joint.
Figure 5B:
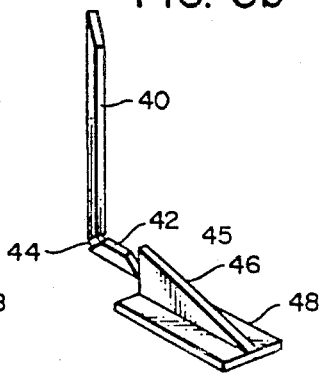
Figure 6A:
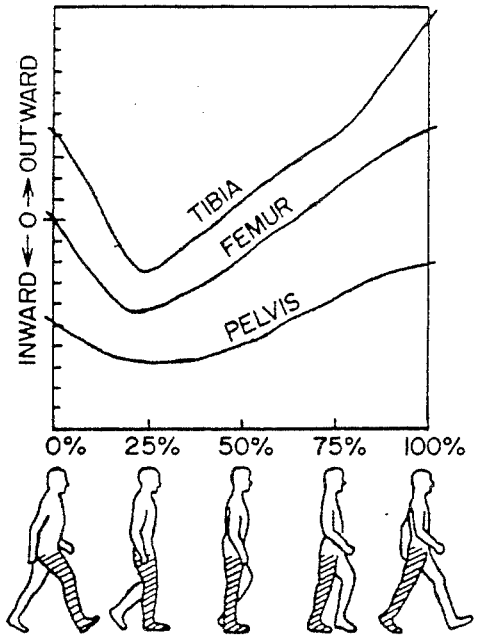
FIG. 6*a* is a graph illustrating the rotational movement of the pelvis, femur and tibia during one-half of a gait cycle.
Figure 6B:
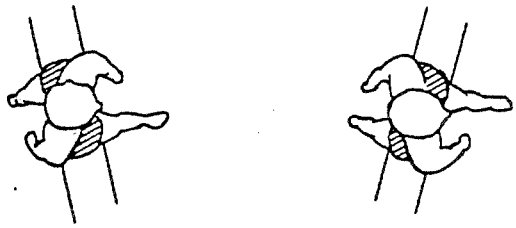
FIG. 6*b* is a top plan view illustrating the rotation of the person's pelvis during that portion of the gait cycle illustrated in FIG. *7a;*
Figure 7A:
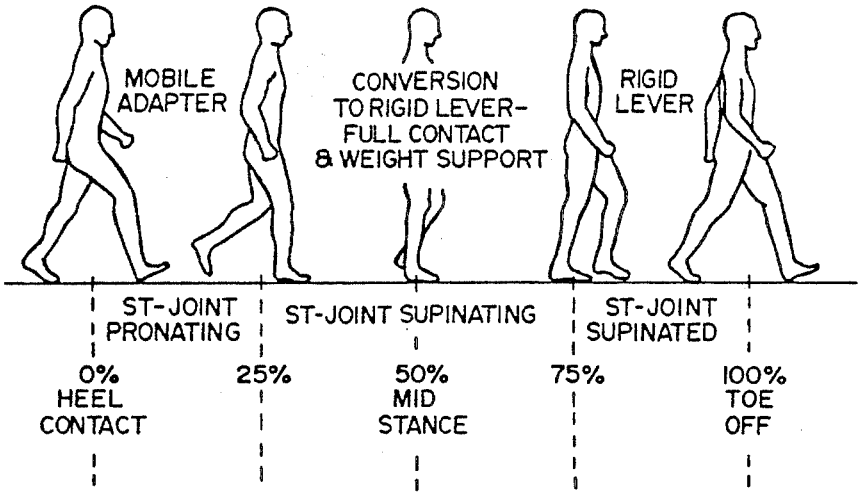
Figure 7B:
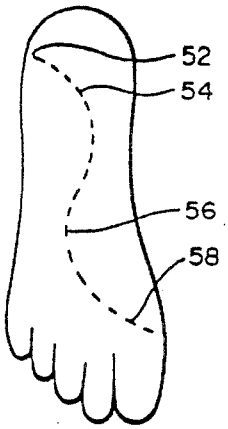

FIG. *7a* is a graph similar to FIG. 6*a*, but illustrating the timing of the pronating and supinating motion of the leg and foot through one-half of a gait cycle;

FIG. *7b* is a view looking upwardly toward the plantar surface of a person's left foot, and illustrating the distribution or location of the center of pressure throughout the period of ground contact of the portion of the gait cycle illustrated in FIGS. 6*a* and *7b;*

Figure 8:
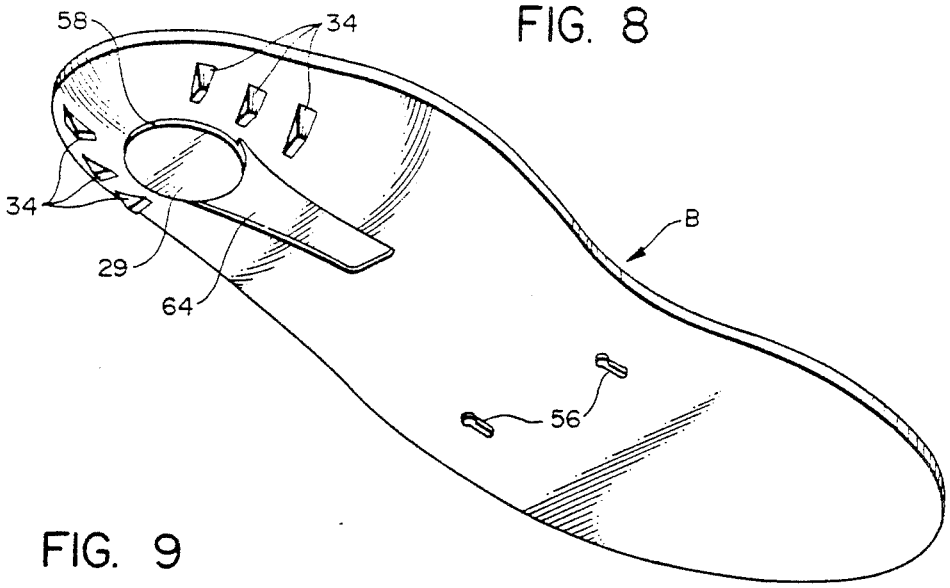
Figure 9:
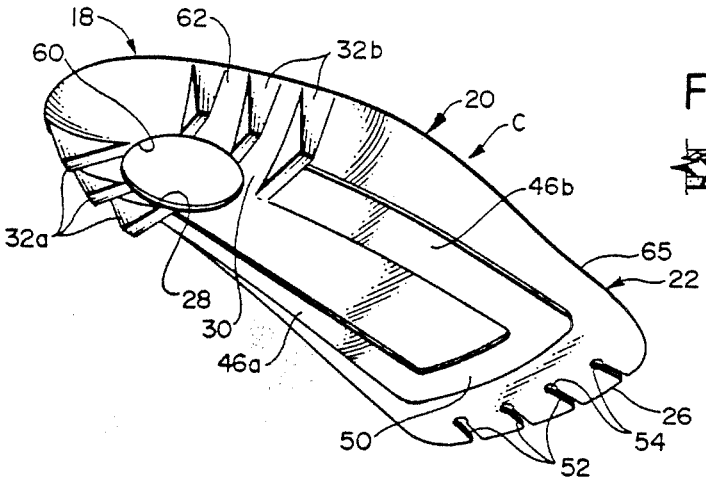
Figure 8A:
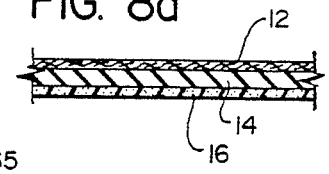
Figure 10:
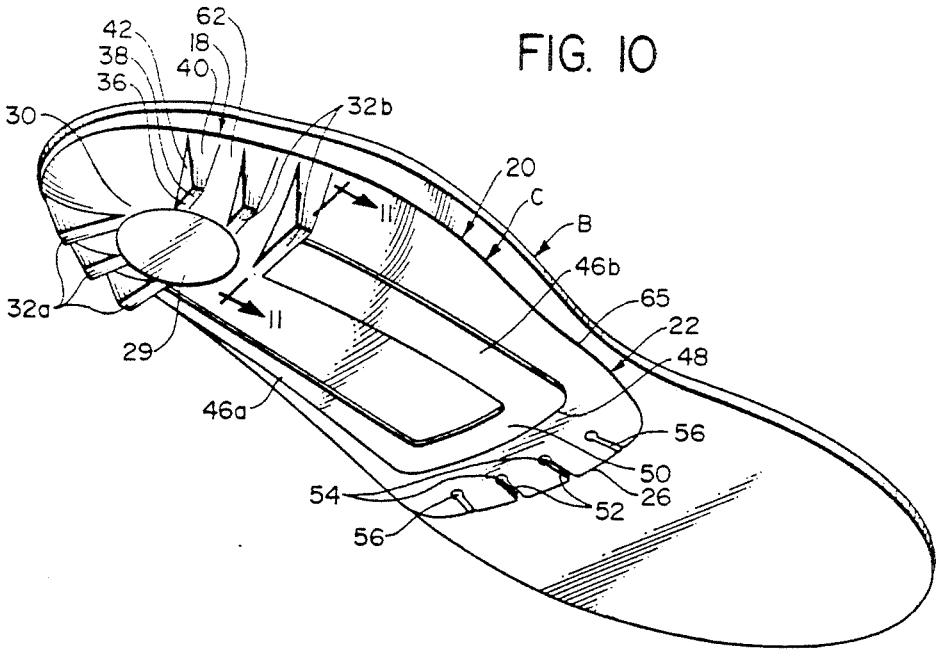
Figure 11:
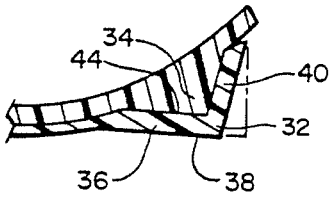
Figure 12:
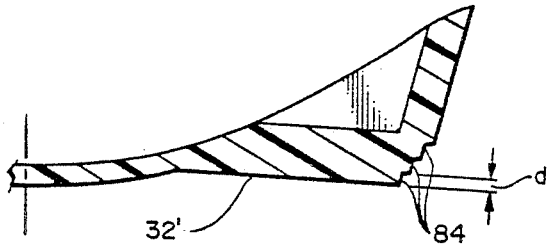
Figure 13:
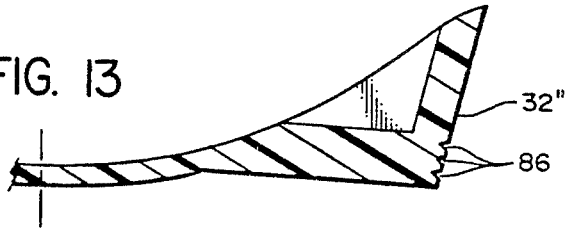
Figure 14:
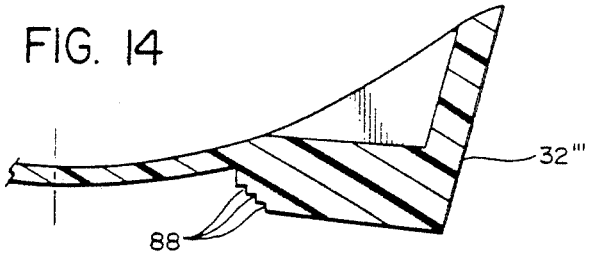
Figure 15:
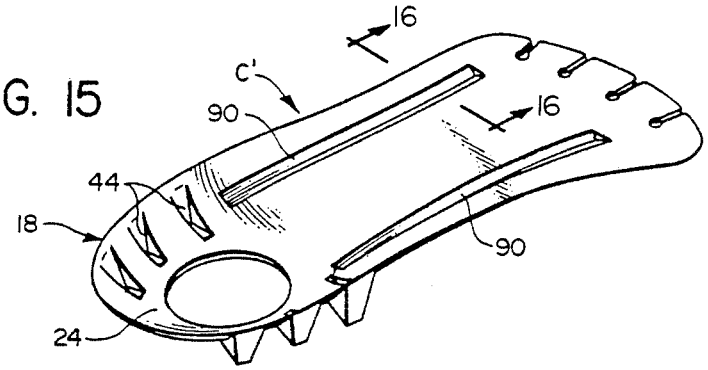
Figure 16:
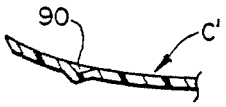
Figure 17:
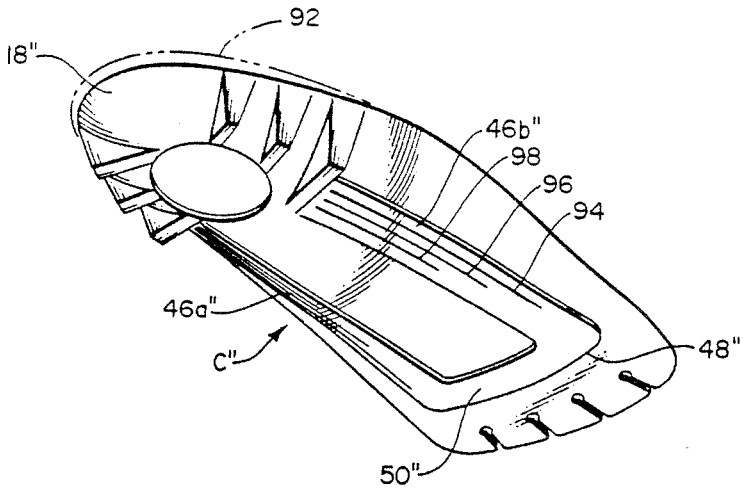

FIG. 8 is an isometric view of a relatively flexible blank used in making the orthotic for the present invention, with the view being taken from a location looking from the side and upwardly toward the bottom surface of the blank;

FIG. 8*a* is a sectional view, drawn to an enlarged scale, showing the layers making up the blank of FIG. 8;

FIG. 9 is an isometric view taken from the same vantage point as FIG. 8, and illustrating a relatively rigid cap which is combined with the blank of FIG. 8 to make the orthotic of the present invention;

FIG. 10 is an isometric view similar to FIGS. 8 and 9, showing the blank of FIG. 8 and the cap of FIG. 9 being combined to make the orthotic of the present invention;

FIG. 11 is a sectional view taken along line 11—11 of FIG. 10, and illustrating the interfitting relationship of a locating element of the blank and a stabilizing element of the cap which make up the orthotic;

FIGS. 12, 13 and 14 are sectional views similar to that of FIG. 11, and illustrating respectively three separate modifications or embodiments of one of the stabilizing elements or posting elements of the cap portion of the orthotic;

FIG. 15 is an isometric view of a second embodiment of a cap which can be used to make an orthotic of the present invention;

FIG. 16 is a sectional view taken along line 16—16 of FIg. 15, and illustrating the configuration of a reinforcing element of the cap of FIG. 15;

FIG. 17 is an isometric view, similar to FIG. 16, but showing a further embodiment of the cap which can be used to make the orthotic of the present invention;

FIGS. 18 through 23 are isometric views illustrating the sequence of steps in assembling the components of the orthotic and in fitting these to the person's foot to form the finished orthotic.

DESCRIPTION OF THE PREFERRED EMBODIMENTS

In the following detailed description, there will first be a discussion of the structure and function of the orthotic made in accordance with the present invention, after which there will be a description of the method by which the orthotic is made. The orthotic 10 of the present invention (shown in FIG. 10) is made from two components, namely a relatively flexible blank B (shown as a separate component in FIG. 8) and a relatively rigid cap C (shown as a separate component in FIG. 9), with the blank B and the cap C being shown joined to one another to make the finished orthotic 10.

In the preferred form, the blank B is a full length member (i.e. extending from the heel of the person's foot to the end of the toes) and this is made as a relatively flexible, yielding, padded member. The basic structure of the blank B is or may be similar to blanks already known in the prior art, and in the present form, it comprises a top layer 12 formed from an abrasion resistance padded material, such as synthetic fabric, nylon, dacron, felt, cloth, or the like. There is an intermediate layer 14 formed from rubber or its equivalent. Then there is a lowermost layer 16 formed from a foamed material, such as Freelen TM, Plastizote TM or other open or closed cell foam which is characterized as being relatively resilient and having sufficient memory to return to its original state when in stress. All three layers 12–16 are capable of moderate shock absorption and are also moderately flexible. While the three layered structure described above is one preferred form of the blank B, it is to be understood that other construction of the padded blank B could be used.

The blank B has certain specific structural features which are present to cooperate with corresponding features of the cap C to provide some of the advantages of the orthotic 10 of the present invention. Some of these will be described in the course of the description of the cap C.

The cap C is formed from a material which is comparatively rigid, when contrasted with the full upper blank B, and may be formed from polyethylene, polypropylene (with or without diluents such as talc), epoxy and fiberglass, or other materials. However, as will be described later herein, the cap C is made so as to be resilient and moderately deflectable. The preferred material of the cap C is characterized in that it can be permanently deformed at a moderately elevated temperature (i.e. 150° to 300° F.), and upon hardening at normal temperatures, it has a predetermined and programmable resistance to deformation in a manner that when distorted, the material will return to its original configuration.

The cap C has a heel or calcaneal portion 18, a midfoot portion 20, and a forefoot or metatarsal portion 22. The upper surface 24 of the heel portion 18 (as shown in FIG. 15) has a moderate concave curve to match the contour of the lower surface of the heel of the person's foot. The forefoot portion 22 is arranged to fit beneath the ball (i.e. metatarsal area) of the person's foot, and the forward edge 26 of the forefoot portion 22 of the cap C terminates just rearwardly of the metatarsal head of the person's foot.

The central part of the heel portion 18 is formed with a centrally located through opening or cutout 28, with this opening 28 being sized and shaped to match the lower culminating portion of the heel of the foot. Normally, this opening 28 has a generally oval configuration, with a width dimension approximately ⅓ of the entire width of the heel of the foot at the location of the opening. In general, the width of the opening 28 would be no greater than ½ of the width, and at the minimum, would be no less than approximately 1/5 to ¼ of the width of the person's heel. The length of the opening 28 would be moderately greater than the width dimension, possibly one and a third to one and a half times the width dimension of the opening 28. This opening 28 receives a downwardly and outwardly protruding lower portion 29 formed on the lower surface of the heel portion 18 of the blank B.

Extending downwardly from the lower surface 30 of the heel portion 18 are a plurality of stabilizing elements 32. In the particular embodiment shown herein, there are six such stabilizing elements 32, three on each side of the heel portion. Three of these elements **32*a* are located at the inside heel portion, and the other three elements 32*b* are located adjacent the outside heel portion. These stabilizing elements 32*a* and 32*b* serve two functions. First, these have a posting function in that these elements 32*a–b* support the heel portion 18 at the proper angular position relative to the underlying shoe, and as will be described later herein, the lower surface of selected elements 32*a–b*** may be ground down to optimize the angular positioning of the heel of the foot.

The second function of these stabilizing elements 32 is to receive matching locating elements or ears 34 which extend downwardly from the heel portion 18 of the blank B.

As shown in FIG. 11, each stabilizing element 32 comprises a lower flat base portion 36 having a lower surface 38 arranged to engage the upper surface of the heel of the shoe into which the insert 10 is inserted. There is an upstanding outer wall portion 40, and two lateral wall portions 42 extending between the base 36 and the outer wall 40. The base 36, outer wall 40 and two lateral walls 42 collectively define a related recess 44 to receive a related one of the aforementioned locating elements or ears 34.

The lower surface of the cap C is formed with two longitudinally extending reinforcing strips or elements **46*a* and 46*b*, positioned along the lower inside and outside surface portions of the cap C, respectively. In the particular form shown herein, each element 46*a* and 46*b* extends from the related forwardmost stabilizing element 32*a* and 32*b*, respectively, to a front location 48, spaced a short distance rewardly from the forward edge 26 of the forefoot portion 22 of the cap C (e.g. approximately ¾ inch rearwardly of the edge 26). The forward end portions of the reinforcing strips or elements 46*a* and 46*b* are joined by a cross strip or reinforcing member 50. In this particular embodiment, the reinforcing strips 46*a–b* are formed as downwardly raised or thickened portions of the cap C, with the depth dimension of these elements 46*a*, 46*b* and 48** below the surface of the cap C being approximately 1/16 inch.

The forefoot portion 22 of the cap C is formed with a plurality (specifically four) of longitudinally extending slots 42 which open to the front edge 26 of the cap C. The rear end of each slot 52 terminates in a slightly enlarged opening or aperture 54. These slots 52 serve two functions. First, pressure can be relieved in certain parts of the metatarsal area by removing a portion of the cap C that is positioned between adjacent slots 52, so that a specific area of the foot is at a different horizontal level when receiving pressure from the support which the cap C provides for the foot, thus providing a relieved area. Also, the slots 52 and apertures 54 provide a locating function to receive corresponding locating elements 56 positioned on the lower surface of the blank B.

To describe now more particularly the structure of the blank B, as discussed above, the lower surface of the heel portion 18 has the six downwardly protruding ears or locating elements 34 which fit into corresponding recesses 44 of the stabilizing elements **32*a–b*. The shape of each ear or locating element 34 corresponds to the shape of the corresponding recess 44 so as to provide a snug fit. Also, the two locating elements 56 are contoured to closely match the configuration of the related slots and apertures 54** so as to interfit with a snug fit.

With regard to the aforementioned downwardly protruding central heel portion 29, as indicated previously, the perimeter 58 of this downwardly raised portion 29 is shaped to match the surrounding edge 60 that defines the aforementioned opening 28. Thus, this downwardly raised heel portion 29 can also serve a locating function relative to the cap C, as well as provided a padded filler for the opening 29.

With regard to the benefits provided by the cap heel opening 28 and the matching raised (i.e. raised in a downward direction) padded portion 29, it should be recognized that it is desirable to keep the total thickness or depth dimension of the orthotic 10 within reasonably small limits, while still providing sufficient support, and also padding or cushioning for the foot in critical areas. The arrangement of the cap heel opening 28 permits an increased thickness of the padding portion 29 to provide greater cushioning at the lower culminating portion of the heel. Further, the removal of the material of the cap C at the central heel opening 28 adds a certain flexibility to the side heel portions 62 (i.e. the heel portions of the cap C positioned on opposite sides of the opening 28) so that when there is a downward force exerted by the heel of the person's foot against the heel portion 18 of the cap C, these side portions 62 are better able to deflect upwardly and inwardly to "cradle" the heel of the foot.

Also, in this particular embodiment, the lower surface of the blank B is formed with a shallow elongate recess 64 extending forwardly from the raised heel portion 29, so as to reduce the thickness dimension of the blank B in the area of this recess 64. As shown herein, this recess 64 is approximately ⅝ inch in depth (or possibly moderately deeper) and about two inches in length, with a width dimension which is approximately ¾ inch to an inch at the location of the heel protrusion 29 and tapering in a forward direction so as to have a width of about ½ inch at the forward end of the recess 64.

To describe the preferred method by which the blank B and cap C are joined to one another and shaped to form the finished orthotic 10 of the present invention, reference is now made to FIGS. 18–23.

Figure 18:
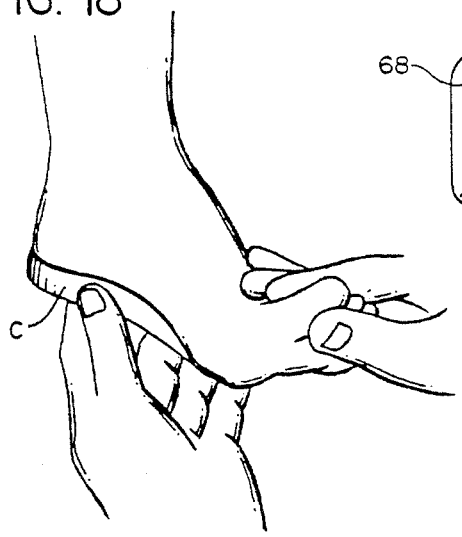

Generally, the first step is to have the person for whom the pair of orthotics are being made to sit on a raised chair. Then the cap C is placed against the person's foot (as illustrated in FIG. 18) to check for size. The leading edge of the cap C should reach just behind the metatarsal heads of the person's foot.

Figure 19:
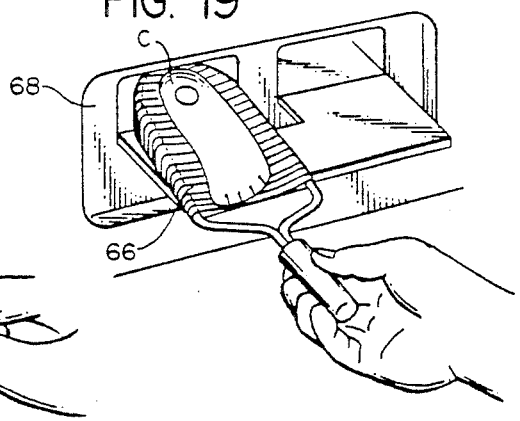
Figure 20:
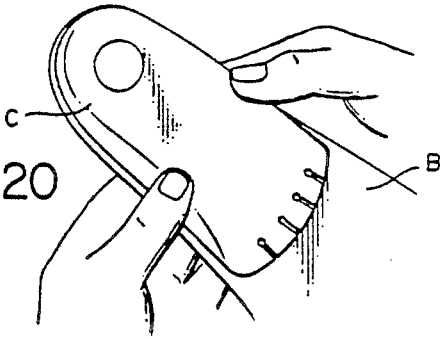

As illustrated in FIG. 19, the cap C is placed on a spatula 66 and placed in an oven 68. In FIG. 19, the heel portion 18 of the cap C is shown as being placed in the furtherest rearward part of the oven. However, if the heating of the oven is not uniform, it may be desirable to place the forward portion 22 of the cap C into the oven first to insure that the midfoot 20 and forefoot 22 portions of the cap C are adequately heated. In any event, the heating step in FIG. 19 is accomplished so that desirably the entire cap C is heated to a moderately elevated temperature (150° by 300° F.) so that the material forming the cap C is sufficiently yielding so that it can be deformed and contoured to the person's foot (as will be described hereinafter) so as to take a permanent set matching the desired contour for the plantar surface of the person's foot.

After the cap C has been adequately heated, it is then pressed against the blank B so that the upper surface of the cap C engages the lower surface of the blank B. As described previously, the lower protruding heel portion 29 fits in the cap heel opening 28; the locating elements or ears 34 fit in the matching recesses 44 of the stabilizing elements 32*a* and 32*b;* and the forward locating elements 56 located in the related forward slots 52 and the apertures 54 of the cap C. The upper surface of the cap C is provided with a suitable adhesive which softens when heated, so that the blank B becomes bonded to the cap C when these are cooled.

Figure 21:
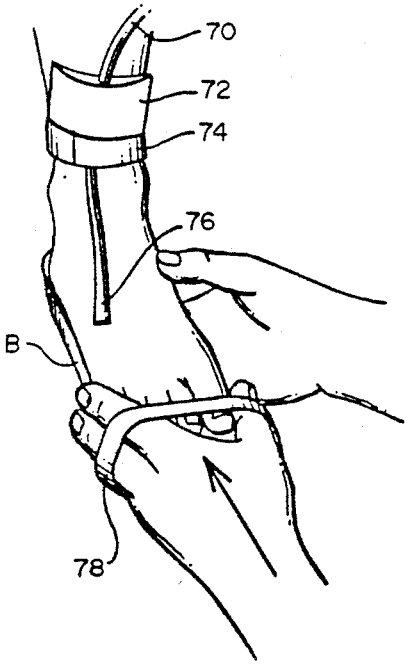

Next, there is the utilization of the vacuum forming technique to properly form the cap C and the blank B to the bottom of the foot. As illustrated in FIG. 21, there is a suction tube 70 that is applied to the person's ankle by means of a fitting 72 and an elastic band 74. The intake end 76 of the tube 70 is on the upper surface of the person's midfoot. An elastic band 78 is slipped around the person's foot to hold the assembled cap C and blank B in place against the bottom of the foot.

Figure 22:
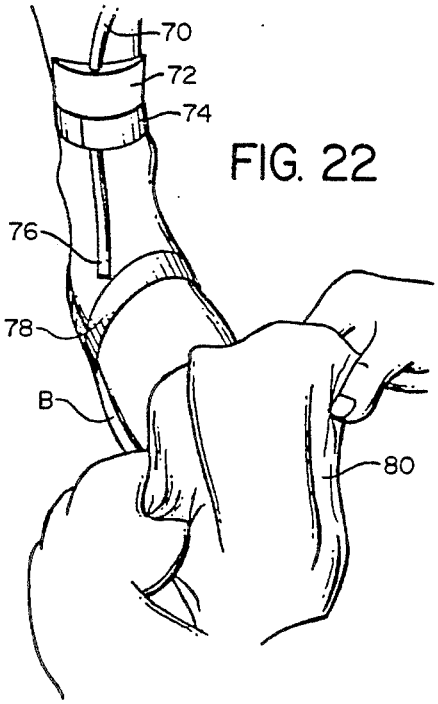

As illustrated in FIG. 22, the next step is to place a flexible transparent plastic bag 80 around the foot and upwardly around the ankle. As shown in FIG. 23, the upper part of the bag which is around the ankle is pressed against the ankle by means of a peripheral band 82. The assembled components (i.e. the cap C and the blank B) are then pressed gently against the heel of the person's foot. Then a vacuum pump is turned on to suck air through the tube inlet 76 to cause the bag 80 to press the assembled components against the bottom of the person's foot with the appropriate pressure.

Then, the operator positions the foot in the desired position, and then specifically positions the forward part of the foot appropriately relative to the rear portion of the person's foot. As indicated previously, this will generally be done in a manner so that the foot is in the neutral position, with the forward part of the foot being positioned so that the midtarsal joint is in its locked or nearly locked position.

It is to be understood that the cap C, when heated, is sufficiently yielding so that the force of the atmospheric pressure (resulting from the application of the vacuum within the bag 80) is sufficient to shape the cap C so that it will properly conform to the lower surface of the person's foot. Thus, with the operator properly positioning the person's foot, the cap C, and consequently the blank B, assume a shape closely corresponding to the plantar surface of a person's foot, where the foot is in the optimized position, as discussed above.

Within a short period to time, the cap C will cool to room temperature, so that the cap will harden into the proper configuration which it had assumed during the vacuum forming step described above. Further, upon cooling, the cap C becomes bonded to the blank B to form the finished insert.

An orthotic 10 for the other foot is made in substantially the same manner as described above. It becomes apparent from the above description that one of the significant advantages of the present invention is that a finished pair of orthotics, custom contoured to accommodate the individual characteristics of the person's foot, can be produced relatively quickly and easily.

With regard to the particular characteristics of the orthotic 10, when the orthotic 10 is placed in the person's shoe, normally it will be supported from the upper surface of the sole of the shoe by the six stabilizing elements 32 and by the lower surface of the forefoot portion 22 of the cap C. In most instances, the midfoot portion 20 of the cap C of the finished orthotic 10 will be spaced upwardly a moderate degree from the underlying upper surface of the sole of the shoe. Thus, the orthotic 10 is in a sense three-dimensional.

In the operation, when the person places his or her weight on the foot (e.g. in the midstance phase of the gait cycle), there will be a tendency for the foot to elongate moderately as the entire plantar surface presses against the upper surface of the orthotic 10. The configuration and resiliency of the orthotic 10 is such that the midfoot portion can deflect downwardly to a moderate extent upon the application of pressure from the foot, and upon release of the weight on the foot, the midfoot portion of the orthotic will again spring back (due to the resiliency of the cap C) to its original position.

It should be noted that the method of the present invention differs from the prior art techniques described under "BACKGROUND OF THE INVENTION", in that the cap C is made of a material which is moderately yielding at a sufficiently low temperature (e.g. 150° to 300° F.) so that the cap C can be conveniently manually manipulated and applied to the person's foot (as described above) while still in a moderately yielding condition. Thus, the cap C itself changes its shape and becomes contoured to the plantar surface of the person's foot. This is in contrast to the method described in the aforementioned U.S. application Ser. No. 766,049, where the underlying cap itself remains substantially rigid throughout the forming process, with the cork insert material being molded to the proper contour to properly match the person's foot.

Further, the aforementioned longitudinally extending reinforcing elements or strips 46*a* and 46*b* are arranged to provide additional support in a longitudinal direction. These strips or elements 46*a–b* will resist to the proper extent downward deflection of the midfoot portion of the orthotic 10, and yet provide very little resistance to upward and lateral deflection of the side portions of the orthotic. Thus, the side portions of the length of the orthotic will have a tendency, upon downward deflection of the orthotic 10, to move upwardly and inwardly (relative to the longitudinal middle portion) to cradle or cup the person's foot for proper supporting engagement.

It will be noted that the upper side edges 65 of the midfoot and forefoot portions are not formed with upstanding flanges or side portions, but rather terminate at approximately the outer side locations of the person's foot. This enables the cap C to flex in a manner that the midfoot portion 20 of the cap C can deflect downwardly under the force exerted by the person's foot, as described above.

Further, as mentioned previously, the arrangement of the cap heel opening 28 and the matching thickened heel padded portion 29 provide extra cushioning for the heel, while not unnecessarily increasing the overall depth of the orthotic 10. Further, as mentioned previously, the cap heel opening 28 adds some flexibility to the heel portion of the cap C to enhance the cradling effect of the sides of the heel portion of the cap C. The aforementioned elongate recess 64 in the blank B permits relatively greater downward deflection of that portion of the blank C at the recess 64, while causing the blank portions positioned on opposite sides of the recess 64 to provide moderately greater cushion support for the foot.

With regard to the stabilizing elements 32*a–b*, it was indicated previously that material can be removed from the lower surface of these elements 32*a–b* so as to position the heel portion of the orthotic in a desired angular relationship relative to the shoe which provides the underlying support. This can be done by a simple grinding operation. More commonly, the operator or practitioner would want to grind down the outside stabilizing elements 32*b* so as to properly preposition the heel portion of the person's foot during initial heel strike in the gait cycle. This will depend, of course, upon the particular characteristics and peculiarities of the person's foot and other factors.

To simplify the removal of material from the stabilizing elements 32*a–b*, several possible modifications to the stabilizing elements 32 are shown in FIGS. 12–14.

In FIG. 12, there is shown a stabilizing element 32', and this is substantially the same as the previously described stabilizing element 32*a–b*, except that the lower outer surface is formed with a plurality of notches 84 (i.e. three notches as shown herein), with these three notches 84 being formed in stepped fashion. The vertical dimension of each of these notches 84 is such that by removing the lower surface material equal to the vertical dimension of one of the notches, the angular relationship of the heel portion of the orthotic 10 can be changed relative to the underlying sole of the shoe. For example, the vertical dimension of the lowermost notch 84 is indicated at "d", and by grinding off the lower surface of the element 32' to the upper level of the lowermost notch 84, the tilt or angular position of the heel portion of the orthotic 10 can be changed by a desired increment, such as a 2° change in angular position. By grinding off the material equal to the depth of the next upward notch 84, an additional 2° change in the angular orientation of the heel portion of the orthotic can be achieved. Obviously, the number and depth dimension of these notches 84 can be modified to indicate angular incremental changes of greater or less magnitude.

In FIG. 13, there is shown a further modified locating element 32'', and this embodiment, instead of forming notches in a stepped pattern, provides a plurality of notches 86 which are recessed into the lower side wall portion of the locating element 32''. As described above, these V-shaped notches 86 provide a convenient means of indicating to the operator or practitioner the amount of material which needs to be removed to obtain a particular angular orientation of the heel portion of the insert 10.

In FIG. 14, a further modification of the locating element 32 is indicated at 32'''. In this instance, there are stepped notches 88, such as the notches 84 as shown in FIG. 12, but these stepped notches 88 are located along the inside surface of the element 32'''.

A further modified embodiment of the present invention is illustrated in FIG. 15. There is shown a cap C', which is substantially the same as the cap C of the first embodiment, except that the reinforcing elements or strips 46*a* and 46*b* are removed, and reinforcement along longitudinal lines is accomplished by deforming the surface of the cap C downwardly to form an elongate reinforcing member 90 having a "V" configuration. More particularly, the thickness of this reinforcing member 90 is the same as that of material formig the overall cap C, and the reinforcing is accomplished by in effect forming a structural beam by forming an elongate V configured section.

Yet another modified embodiment of the present invention is shown in FIG. 17, where there is shown a cap " which is substantially similar to the cap C of the first embodiment. In this embodiment, the outer peripheral edge of the heel portion 18 of the cap C'' is extended outwardly (shown in broken lines at 92) beyond the stabilizing elements 32*a''–b''*. The reason for this is as follows. The width of the person's heel will vary, and with the added lateral heel portion 92, the heel portion 18'' of the cap C'' will have sufficient width to provide full support for the plantar surface of a relatively wide heel of a person's foot. On the other hand, to accommodate the relatively narrow heel of the person's foot, during the forming process, the outer edge portion 92 of the heel portion 18'' will be formed upwardly around the heel of the person's foot to provide more of a cradling effect for the heel. Because the cap C is made of a material which at moderately raised temperatures can be moderately deformed, this extended heel portion 92 can be used very effectively to accommodate situations where the heels of the various feet are of different widths.

Anoother feature of the embodiment shown in FIG. 17 is that the lower reinforcing elements or ribs 48*a''* and 46*b''* can be provided with additional reinforcing in the form of downwardly protruding ridges or beads. Three such ridges are shown on each reinforcing element 46*a''–b''* in FIG. 17. There is an outer ridge 94 which extends substantially the entire length of the element 46*b''*. There is a middle ridge 96 which extends from the rear edge of the element 46''. Finally, there is an innermost reinforcing bead or ridge 98 which extends from the rear of the reinforcing element 46*b''* to terminate at a further rearward location. By grinding off selected ones of the reinforcing ridges 94, 96 or 98 (or portions thereof), the desired strength or resiliency of each of the reinforcing elements 46*a''* and/or 46*b''* can be controlled more accurately.

It is to be understood that various modifications could be made to the present invention without departing from the basic teachings thereof.

I claim:

1. A method of making a custom fit orthotic, said method comprising:

a. providing a relatively rigid cap made of a material which is characterized in that at a lower temperature, the material is resilient and upon deformation tends to return to its original shape, and at a moderately elevated temperature, can take a permanent deformation which then becomes fixed at said lower temperature;

b. providing a relatively flexible blank member configured to fit beneath and engage a plantar surface of a foot;

c. heating said cap member to said moderately elevated temperature;

d. fitting said blank against an upper surface of said cap;

e. placing said cap and said blank against the plantar surface of the foot, while the cap is at the elevated temperature, and applying a substantially uniform pressure against an outer surface of at least said cap so as to cause said cap to assume a configuration and contour matching the plantar surface of the foot;

f. permitting said cap and said blank to cool so as to become bonded to one another and to form said orthotic which is contoured to properly fit against the plantar surface of the person's foot.

2. The method as recited in claim 1, wherein said cap has a heel portion, a midfoot portion and a forefoot portion, said method further comprising providing said heel portion with a centrally located through opening positioned at a lower culminating portion of a heel of the foot which engages the orthotic, with a middle heel portion of said blank overlying said opening, whereby additional cushioning effect is provided at the middle central heel portion of the blank.

3. The method as recited in claim 2, further comprising providing the central heel portion of the blank with a downwardly protruding blank portion which fits within said opening.

4. The method as recited in claim 1, wherein said blank is provided with stabilizing element means connected to and extending downwardly from lower side surface portions of a heel portion of the cap, said blank being formed with downwardly protruding locating element means configured to fit into a corresponding recess means provided by said stabilizing element means, said method further comprising interfitting said blank and said cap so that said locating element means properly fits in said recess means so as to properly locate the blank relative to the cap.

5. The method as recited in claim 4, wherein said stabilizing element means comprises first and second sets of stabilizing elements located on opposite sides of the heel portion of the cap, with at least some of said stabilizing elements having recesses to receive matching locating elements connected to and extending downwardly from said blank.

6. The method as recited in claim 4, wherein said cap has a forefoot portion, arranged with slot means, and said blank has on a lower surface thereof matching second locating element means adapted to interfit with said slot means, said method further comprising interfitting said locating element means with said slot means.

7. The method as recited in claim 6, wherein said slot means comprises a plurality of longitudinally extending slots positioned at spaced locations at the forefoot portion of the cap, said method further comprising removing at least a selected portion of said cap positioned between an adjacent pair of slots, so as to provide a pressure relief area at the forefoot portion of the cap.

8. The method as recited in claim 1, wherein a heel portion of said cap has laterally extending side portions dimensioned to extend beyond a heel of a foot of a narrower width, said method further comprising applying pressure to said side portions of the heel portion of the cap, while the cap is at the elevated temperature, to deform said side portions upwardly to cradle said foot of narrower width.

9. The method as recited in claim 1, wherin a heel portion of said cap has stabilizing element means connected to and extending downwardly from the heel portion of the cap, said stabilizing element means having vertically spaced notch means identifying vertically spaced locations on said stabilizing element means, said method further comprising removing a lower surface portion of said stabilizing element means, utilizing said notch means as a depth indicator, thus insuring controlled removal of material from the stabilizing element means to a desired depth.

10. The method as recited in claim 1, wherein said pressure is applied against said cap and said blank by enclosing said cap and said blank and also the foot in a bag, and applying a vacuum within said bag, to cause atmospheric pressure to pressure said cap into a configuration of proper engagement with the plantar surface of the foot.

11. An orthotic made in accordance with the method of any one of claims 1, 2, 3, 4, 5, 6, 7, 8, 9 and 10.

* * * * *